US009440843B2

(12) United States Patent
Polzin

(10) Patent No.: US 9,440,843 B2
(45) Date of Patent: Sep. 13, 2016

(54) MOBILE PLATFORM FOR DISPENSING FUEL FROM ANY TANK

(71) Applicant: Kurt A. Polzin, Owens Crossroads, AL (US)

(72) Inventor: Kurt A. Polzin, Owens Crossroads, AL (US)

( * ) Notice: Subject to any disclaimer, the term of this patent is extended or adjusted under 35 U.S.C. 154(b) by 280 days.

(21) Appl. No.: 14/323,972

(22) Filed: Jul. 3, 2014

(65) Prior Publication Data

US 2015/0013838 A1 Jan. 15, 2015

Related U.S. Application Data

(60) Provisional application No. 61/842,826, filed on Jul. 3, 2013.

(51) Int. Cl.

| | |
|---|---|
| ***B65B 37/00*** | (2006.01) |
| ***B67D 7/84*** | (2010.01) |
| ***B67D 7/22*** | (2010.01) |
| ***B67D 7/14*** | (2010.01) |
| ***B67D 7/24*** | (2010.01) |
| ***B67D 7/78*** | (2010.01) |
| ***B67D 7/32*** | (2010.01) |
| *B67D 7/26* | (2010.01) |
| *B67D 7/74* | (2010.01) |

(52) U.S. Cl.

CPC ..... *B67D 7/845* (2013.01); *B67D 7/145* (2013.01); *B67D 7/224* (2013.01); *B67D 7/228* (2013.01); *B67D 7/246* (2013.01); *B67D 7/3281* (2013.01); *B67D 7/78* (2013.01); *B67D 7/26* (2013.01); *B67D 2007/746* (2013.01)

(58) Field of Classification Search

CPC ..... B67D 7/845; B67D 7/246
USPC ..... 141/231
See application file for complete search history.

(56) References Cited

U.S. PATENT DOCUMENTS 7,156,134 B1 * 1/2007 Brakefield ..... B67D 7/04 141/231

* cited by examiner

*Primary Examiner* — Jason K Niesz
(74) *Attorney, Agent, or Firm* — Mark Clodfelter

(57) ABSTRACT

A mobile or portable pumping platform for being conveyed to a point of use where there are tanks containing a liquid, such as fuel, to be dispensed is disclosed. The platform comprises at least one station including a display indicating at least price/quantity of liquid to be dispensed, and possibly type of liquid. In some embodiments, the platform includes at least one metering station and a computer for calculating price of dispensed fluid. The pumping platform may be mounted to a truck or skid and deployed for use, or configured as a trailer to be towed to a point of use.

18 Claims, 3 Drawing Sheets

MOBILE PLATFORM FOR DISPENSING FUEL FROM ANY TANK

CROSS REFERENCE TO RELATED APPLICATIONS

This application claims the benefit of U.S. provisional application No. 61/842,826, filed Jul. 3, 2013, and which is incorporated by reference herein.

FIELD OF THE INVENTION

This invention relates generally to fuel pumping and metering stations, and particularly to a self-contained, self-powered mobile or portable pumping and metering system for dispensing, metering and charging for pumped and dispensed fluids, particularly fuel.

BACKGROUND OF THE INVENTION

It is the object of the present invention to provide a mobile platform for use in emergencies and the like and which can be used to extract, meter, dispense and charge for dispensed fluids from tanks when no other means of performing this task is available. More specifically, the platform is readily deployable to any location, and has its own on-board electrical power source and pumps for extracting and dispensing fuels from service station or storage tanks that may contain fuel, but otherwise are unusable due to events that render dispensing systems and pumps inoperative.

In particular, where hurricanes, tornadoes, floods, earthquakes, or other events have knocked out electrical power over a relatively wide area, service stations, convenience stores and the like cannot provide fuel to customers without auxiliary electrical power generators. However, those relatively few stations that are undamaged and which have such auxiliary power generators typically run out of fuel quickly in emergency situations. In other situations, fueling stations, convenience stores and the like may be so badly damaged in a widespread area that their fixed fuel dispensing stations cannot be used to pump fuel from tanks that contain fuel. Thus, there may be an adequate supply of fuel in tanks in the damaged or devastated area, but it is simply inaccessible and there is no way to quickly and easily meter and charge customers for the fuel.

DETAILED DESCRIPTION OF THE DRAWING

Figure 1:
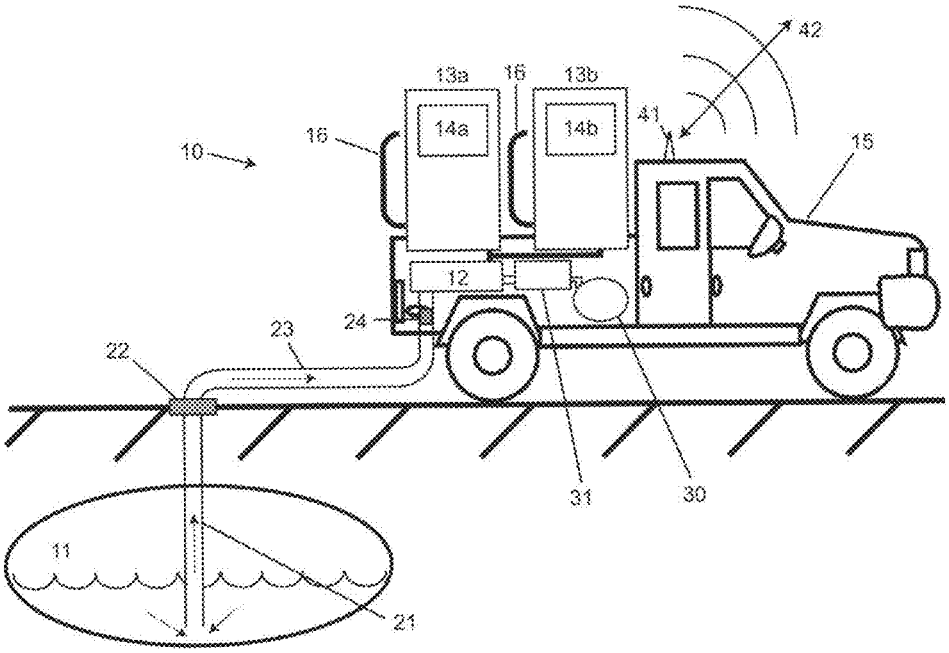
FIG. 1 is an illustrative schematic diagram of a mobile platform of the present invention for dispensing fuel from any tank.

Referring now to FIG. 1, a mobile platform 10 for dispensing and metering fuel from any tank 11, either underground or aboveground, is shown. It is to be understood that the present invention can be used to draw any type fluid from a source or tank not on or associated with the mobile platform and dispense the fluid to any type of vehicle or container. For example, and in most instances, the fluid can be fuel, such as gasoline, diesel or any other fuel stored in underground tanks such as those found at a service station, and typically dispensed into the tank of a vehicle. Likewise, aviation fuel may be similarly dispensed into an aircraft, or into an aircraft tanker truck used at airport tarmacs for conveying fuel to an aircraft for refueling. Similarly, a liquefied gas under pressure, such as propane or liquefied natural gas (LPG), may be dispensed and metered by the present invention. Other liquids, such as water, may also be dispensed as described by selecting components of the system to be compatible with water instead of fuels.

In some embodiments the mobile platform 10 may be based on a pickup truck 15 as shown, or mounted to a trailer detachable from a tow vehicle, or mounted on a skid that is loaded for transport on a truck or trailer, and unloaded at a location where needed. In some embodiments, the skid may be airlifted by a helicopter or the like so as to provide fuel pumping capability at locations such as islands or mountainous regions where roads have been blocked or washed away.

As noted, platform 10 is provided with equipment mounted thereto that is used at least to pump fluids, such as fuel, that are drawn from a storage tank 11. In some embodiments, equipment such as metering, pricing and credit and debit card charging devices may be incorporated into platform 10. While tank 11 is shown as an underground tank, the tank also may be an above ground tank, such as where propane or LPG is being dispensed. In this instance, platform 10 is outfitted with the appropriate pumps, fittings and hoses and other equipment to handle the higher pressure liquefied gasses.

It is anticipated that in most instances, platform 10 includes fuel dispensers 13A, 13B mounted to platform 10, as by being hung or mounted from a side or both sides of pickup truck or similar small truck 10. In one embodiment, the platform 10 may include a rack that extends laterally across the truck bed and may be supported by tops of the sides of the truck bed in order to support the dispensers on one or both sides of the pickup truck bed and provide access to the pump dispensers from one or both sides of the truck. The platform 10 thusly configured including such a rack may also include bracing that stabilizes the dispensers on top of the sides of the bed by engaging sides of the truck bed and perhaps also connect to or rest on the bottom of the truck bed. The rack may also be constructed so that the dispensers are mounted on slides or rollers to permit the dispensers to slide or roll inward and be secured over or in the truck bed for being transported, and may be moved outward over the sides of the bed of the pickup truck or even extend beyond the sides for convenient use by customers after the truck is in position to deploy the dispensers.

Typically, such fuel dispensers 13A, 13B would be at least similar to the top portion of a self-serve fuel dispenser typically found at convenience stores, refueling stations or the like, and include a resettable pricing/quantity/fuel type display 14A, 14B, respectively. In other embodiments, a display including at least pricing/quantity, and possibly fuel type, may be housed in a smaller enclosure only about as large as the display and related peripherals, with a hose for dispensing fuel or fluid hung from a separate hook, the hose or hoses carried during transport within the bed of the truck. This embodiment would allow platform 10 to be made smaller and more compact so that it could be carried by a small pickup truck or similar vehicle that could travel in places that may be inaccessible to larger vehicles, such as where downed trees and debris may be blocking portions of roads. As noted, when constructed on a skid, platform 10 could be airlifted by a helicopter to locations inaccessible by vehicle. In some embodiments, a computer and billing equipment for fuel control and billing, as by cellular phone service, satellite phone services and the like may be included. In other, simpler embodiments, only a fuel metering display may be provided, with credit card purchases implemented by hand. In yet other systems, billing and payment may be accomplished by use of a "smart phone" attachment that accepts credit and debit cards, and transmits financial information over the cellular system or over the Internet via WIFI where available. As noted, fuel nozzles and hoses 16 for dispensing fuel may be hung from larger dispensers 13A, 13B, or in smaller platforms, from a rack or hook to which the display enclosure or enclosures are mounted. The fuel nozzles and dispensers may be activated conventionally, as by removing a fuel nozzle and its respective hose from its holder and flipping a lever, or energized by an operator of the mobile refueling station. As such, 1 or 2 refueling stations may be provided on each side of the bed of a pickup truck, although hoses for fueling vehicles would need to be of an appropriate length to accommodate 1 or 2 vehicles on each side of the truck. As noted, such an arrangement would allow fuel dispensers to be mounted in or supported by a removable rack on any conventional pickup truck of any size.

Figure 2:
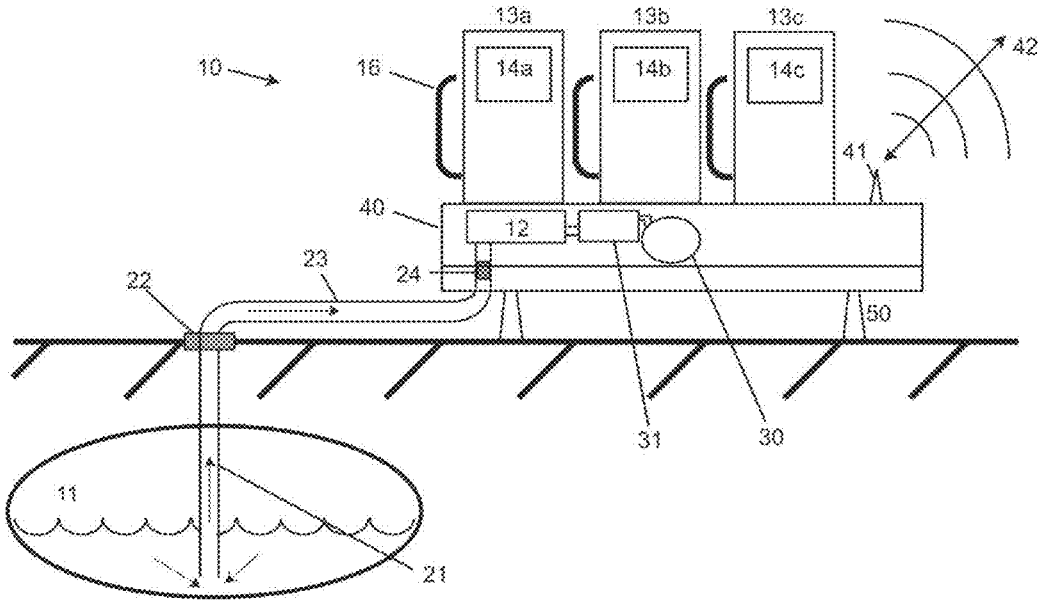
FIG. 2 is an illustrative schematic view of a portable platform of the present invention for dispensing fuel from any tank.

As shown in FIG. 2, and in some embodiments, platform 10 may be constructed on a skid 40 configured to be loaded and unloaded into/from a pickup truck bed or the like. In this embodiment, the fuel dispensers would be conveniently used after platform 10 is unloaded from the pickup truck, although in other embodiments the skid may be left on the truck and the fuel dispensers configured for use from within the pickup truck bed. In other embodiments, platform 10 may be mounted to a larger truck, such as a flatbed truck, or to a trailer that may be towed to a point of use, disconnected and left for use. In yet other embodiments, the refueling stations may be permanently installed in sides of an enclosed truck such as a small van or cube truck. In any event, such mobile refueling stations of the instant invention would be highly advantageous in a disaster area, conflict zone or other similar situations, where there is badly-needed fuel in tanks, such as underground tanks, that otherwise would be inaccessible due to a loss of electrical power or destruction of a fueling station or depot.

In addition to fuel dispensers, and as noted, at least one computer and associated controllers may be provided with the dispensers for controlling operation of the dispensers. In most embodiments, the computer would at least operate displays on the dispensers and may manage a communications system 42, such as a cellular system, for verifying credit and debit card charges, allowing use of credit and debit cards and other charge cards. In these cases, an antenna 41 associated with or mounted to platform 10 would transmit/receive the financial transactions. It may also operate a cash system for accepting cash from customers and dispensing change, or handle a simplified cash system for just accepting bills without dispensing change. The computer could also control the dispensing of fuel from respective dispensers responsive to types of fuel selections made by customers, monitor fuel flow rates and possibly monitor remaining fuel in the underground tanks. In other, simpler embodiments, also as noted, fuel may be metered mechanically, as by a mechanical flow meter, with billing performed manually, as by mechanical credit card devices that impress credit card information on slips of paper that are later turned in to a credit card processing center.

As shown in FIG. 1, one or more fluid pumps/motors 12 may be provided for pumping fluid from a fluid supply in tank 11, and which may be the same as or similar to fuel pumps used in commercial service stations. Due to the need to pump more than one grade or type of fuel where gasoline and diesel fuel is dispensed, a single motor may be interfaced or ganged to several pumps, one pump for each grade or type of fuel. The pump for each grade or type fuel may feed all the dispensers for that grade or type fuel. Thus, where there are 4 dispensers or fueling stations on a trailer, skid or truck, with each dispenser providing selections of gasoline grades such as 87 octane, 89 octane and 92 octane, along with diesel fuel, there could be one motor driving 4 pumps, a first pump for 87 octane, a second pump for 89 octane, a third pump for 92 octane and a fourth pump for diesel fuel. Where necessary, a pump for E85 fuel may be provided. Where a single motor is interfaced to several pumps, either for feeding a single dispenser or all the dispensers associated with a fueling platform of the present invention, the single motor could drive one or more shafts to which the pumps are connected via selectable clutches, belt drives and the like so only the pump associated with a particular fuel selection by a customer is activated by its respective clutch at a time. As such, where there is a single motor and four pumps for the fuel dispensers, one pump for each grade/type of fuel, a customer on one side of the fueling platform may be pumping 87 octane gasoline, causing the 87 octane pump to be operating, while on the other side of the fueling platform another customer may be pumping diesel fuel, causing the diesel fuel pump to be operating. The pumps for 89 octane and 92 octane gasoline would then not be operating. Where 2 or more customers are pumping the same grade of gasoline, such as 87 octane, the flow from the one pump would be simply divided and provided to the respective customers by the valves on the dispensing nozzle that is operated by the customers. Here, all the dispensers would be connected to a single pump for each grade/type of fuel. As such, no additional valving should be needed to control the flow of fuel to 2 or more customers. The fueling nozzles may be conventional fueling nozzles that maintain pressure inside the fuel system so that when a fuel lever of a nozzle is operated by the customer, the pressure for that fuel grade or type in the system is released, and causes the motor and respective pump to become energized to pump fuel of that grade or type. As should be apparent, and in most embodiments, where different fuels are being dispensed, a separate hose or tube would be inserted into each tank holding a respective different type of fuel, and connected either to a separate pump for, that type of fuel as described above, or a common pump that pumps all the fuels, with selection of which fuel to pump being made by the customer at the dispenser. In this instance, a valving system connected to the hoses in the gasoline tanks would switch to the selection of gasoline made by the customer. While a system using a common pump may cause mixing of small quantities of fuels that remain in dispensing hoses, such mixing of small quantities of different grades of gasoline may not be an issue in an emergency, but mixing of gasoline with even small quantities of Diesel fuel would be prohibitive. In this instance, one pump may be used for all grades of gasoline, while a separate pump and dispensing system could be used for Diesel fuel. In accordance with convention, the dispensing nozzles are sized in accordance with the type fuel dispensed. In other words, a nozzle for dispensing Diesel fuel would be too large to fit the filling port of a gasoline powered vehicle. In addition, proportional valving systems may be used wherein a single pump is used to pump gasoline drawn from all tanks simultaneously, with an adjustable proportioning system used to mix the various grades of gasoline together in a proportion depending on the quantities of the various grades of gasoline available in the tanks at any one station. This would ensure that all the gasoline is dispensed simultaneously as a single, composite grade that virtually all consumer vehicles could use, while not running out of any single grade of gasoline. As such, all the gasoline in the various tanks would be depleted at approximately the same time. Such a system would make the apparatus of the instant invention simpler by using a single pump for gasoline instead of multiple pumps. The proportional valving system could simply be a valve connected to each hose in the existing gasoline tanks, with a common manifold or connection to the pump to which the flow from each valve is connected. Each valve would be opened an amount according to the amount of fuel in a respective tank so that the single pump draws proportionally from all tanks simultaneously. E85 gasoline would not be used, or would be used to adjust alcohol proportion in alcohol-depleted gasoline as discussed below. Pricing of the single, composite grade of gasoline could be adjusted in accordance with the quantity of each grade of gasoline available at each fueling location.

In other embodiments, there may be a separate motor and pump assembly for each grade and type of fuel, with each discrete motor and pump assembly feeding all the dispensers, or each dispenser could have its own smaller motor and pump assemblies, or a single motor that drives all the pumps for that dispenser.

For supplying electricity to the fueling platform, it is contemplated that an electrical generator 31 be integrated with the system. For an embodiment mounted to a small truck or trailer, a generator of about 5 kW to 10 kW may suffice, although its capacity may vary depending on the power needed to pump fuel and other electrical requirements. In some embodiments, the generator may be an inverter generator to provide a stable power voltage and waveform for the computerized systems, or a separate inverter and power conditioning components may be provided for the computer system. The generator may be provided with its own fuel supply 30, may draw fuel from the truck associated with the fueling platform, or use fuel pumped from an underground tank. In some embodiments, the generator may be powered by natural gas, propane or gasoline. In any instance, the generator would be used in a safe location, such as in its own compartment, or located a distance from the pumps and hoses of the system. In other embodiments, a battery bank and inverter system may be used in conjunction with a generator to provide electrical power to the fueling system.

For drawing fuel from an underground tank, a generally flexible hose 21 is be inserted into tank 11 through a port 22 in tank 11, which may be the same port used to fill storage tank 11. In some embodiments, a filling port interface 22, such as a Cam Loc connector used by tanker trucks, may be used to ensure a leak-free connection with the fill port, except the port interface or fill connector of the present invention would be modified to accept a hose or rigid tube that would extend from below the connector down to the bottom of the storage tank in order to draw fuel from the tank. Other low-leakage fittings may be employed, such as 'TODO' fittings and 'Epsilon' fittings. In other embodiments, an underground tank may already be provided with a connector or outlet from which fuel may be drawn for emptying the tank, such as where the tank is leaking or being replaced. Such an outlet may also be used by a fueling platform of the instant invention.

A filter 24 would typically be used to filter contaminants and sediments from the fuel, and which may include a water separator for removing at least small amounts of water, at least in fuels not mixed with ethanol. Where larger quantities of water have entered an underground tank due to flooding, gasoline containing ethanol may be unusable, at least in some vehicles, due to the reduction in octane that occurs when gross amounts of water in a tank containing gasoline with alcohol leaches or draws the ethanol out of the gasoline, and the gasoline separates from the water/ethanol mixture. However, such fuel might still be used in an emergency in some vehicles equipped with fuel computers and knock sensors, which adjust engine parameters such as ignition and valve timing to eliminate knock caused by use of a lower octane fuel. In other instances where water contamination has occurred and the fuel has separated into a gasoline and a water/ethanol mixture, one or more injectors, such as a Venturi injector or small pump, may be provided in the fuel flow system and which incorporates a fuel flow meter for measuring flow of fuel, and a regulator in order to inject proportional or metered quantities of a remedial agent to gasoline from which the ethanol has been leached by gross water contamination. Mixing of the remedial agent may be through turbulent Venturi action, or by providing the remedial agent to the fuel flow just before the main pump so that the pump mixes the remedial agent with the fuel. Such remedial agents may include ethanol or another alcohol in an amount to at least partially restore the alcohol that was removed, such as from 5% to 10% or so, as might be determined by testing the contaminated gasoline using a chemical test kit or octane testing equipment. Another remedial agent might be a higher octane gasoline, such as 91-93 octane gasoline, mixed with alcohol-depleted 87 octane E10 gasoline in order to raise the octane level of the depleted E10 gasoline to a usable level. E85 gasoline, which is 85% ethanol, may also be mixed with E10 gasoline from which ethanol has been leached to provide a gasoline that is up to 10% ethanol. In other embodiments, a different octane-raising compound may be used, such as MTBE (methyl tertiary butyl ether), ETBE (ethyl tertiary butyl ether), iso-octane or any other compound conventionally used to raise octane level in gasoline. It should be noted that a remedial agent added by an injector or other mixer to E10 gasoline exposed to water could also include any of a number of commercial preparations advertised for "drying" gasoline, or otherwise improving its properties, because almost all such preparations are mostly ethanol or another alcohol. Of course, in most instances where an underground storage tank contains water with leached ethanol at the bottom, such a mixture could be drawn off by inserting a small hose to the bottom of the tank, and pumping the water/ethanol out until only gasoline is being pumped. In other embodiments, the hose or tube that supplies the dispensers could be lowered into the tank to a point above the water/ethanol layer so that only gasoline is drawn from the tank. Any remedial agents as described may be stored in a tank and conveyed to a site by the mobile platform of the instant invention, towed on a separate trailer or brought to a location where the mobile platform is being used by a separate vehicle or trailer.

Referring to FIG. 2, and as noted, the platform 10 of FIG. 1 may be mounted on a skid 40 for deployment. Skid 40 may be provided with legs 50 to support the skid above a ground or asphalt surface, such as may be found in an area where flood waters are receding. Legs 50 may be configured to be foldable into or even with a lower edge or surface of the skid for loading onto a transporting vehicle, and unfolded when deployed. Small wheels (not shown) may be provided so that the skid may be conveniently positioned after being deployed. In some embodiments, such small wheels may be retractable and extendable so that the skid may be moved conveniently after deployment and then stabilized on a surface by retracting the wheels. Shock absorbers may be incorporated with legs 50 or skid 40 when aircraft are used to transport platform 10.

Figure 3:
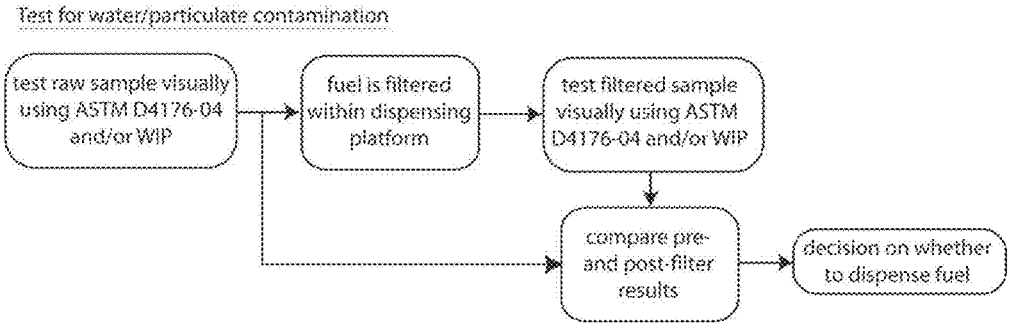
FIG. 3 illustrates a flow process for determining quality of fuel before and after dispensing.

Gasoline may be visually field tested by the procedure specified in ASTM D4176-04, entitled STANDARD TEST METHOD FOR FREE WATER AND PARTICULATE CONTAMINATION IN DISTILLATE FUELS (VISUAL INSPECTION PROCEDURES) in order to determine cleanliness and presence of water and particulates in fuel. In preparation for dispensing, and as shown in FIG. 3, a first fuel sample taken from a tank 11 may first be field tested using the ASTM-D4176-04 test to determine its quality. If found to be uncontaminated, the fuel can be dispensed immediately. If the fuel is found to contain particulates and/or water, then another sample may be taken from the dispenser and retested to check how well filter 24 (FIG. 1, 2) is cleaning the fuel. Here, an oversized or high capacity filter may be used due to anticipation that the fuel may be contaminated. In any case, a decision can then be made as to whether the contamination is so severe that the fuel can't be used.

Figure 4:
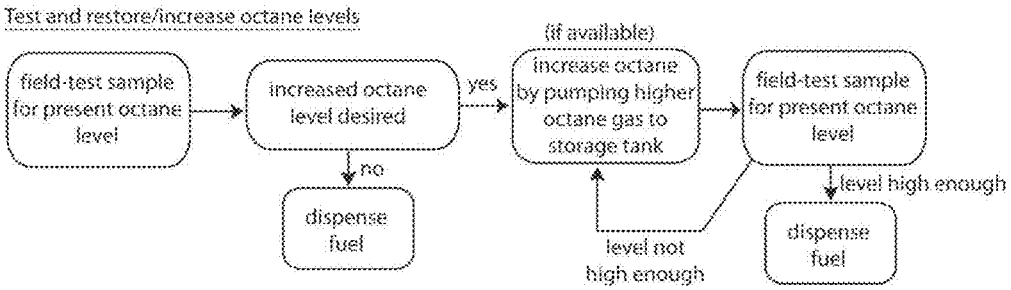
FIG. 4 is a flow process for testing an octane level of fuel and correcting an octane level thereof.

In the instance where water is found in E10 fuel, as shown in FIG. 4, a decision is made whether the fuel is usable as it is. Since most vehicles contain computers that control engine knock, and since the need for fuel may outweigh other factors, it may be decided that the fuel should be used anyway, particularly if the octane level is only partially depleted. Where the depletion is too great, which may result in engine damage to some vehicles, then remedial measures may be undertaken to increase the octane rating, as noted above. One simple measure is to add a smaller quantity of higher octane fuel to depleted fuel, retest he depleted fuel and repeat the process until an octane rating of the depleted fuel is sufficiently high so that it can be used. As noted above, other methods may be used to increase octane rating of depleted fuel, such as to use proportional mixers to add a remedial agent to octane depleted fuel as it is pumped.

A good estimate of how much alcohol is in E10 gasoline may be obtained by simply mixing a known quantity of E10 gasoline, such as 100 milliliters, in a graduated cylinder with a small amount of water, such as 10 milliliters, and shaking vigorously. The water will draw most of the alcohol out of solution, which will settle to the bottom of the container. Thus, if there is 15 milliliters of water/alcohol that settles out after shaking, the gasoline contains approximately 5% alcohol. In this case, about 3%-4% of alcohol may be mixed with the gasoline to restore it to at least close to its E10 rating. In other instances, a hand-held octane analyzer such as a ZX-101C portable octane analyzer available from Zeltex, Inc. in Hagerstown, Md. may be used to determine a more precise octane rating of questionable fuel.

Where it is necessary to determine how much fuel is in a tank prior to pumping from it, a gauging stick or sounding tape may be used. Since the tanks are of a known size and capacity, a liquid level indicates quantity of fuel remaining in the tank. A water-indicating paste may also be applied to the gauging stick or sounding tape to indicate contamination of fuel by water. In other embodiments, a float level indicator already mounted in the tank may be accessed, and fuel level determined from it. In yet other embodiments, a level sensor may be disposed on the tube or hose that extends into the tank. Here, such a tube may be a rigid tube that extends to the bottom of the tank, and has a level indicator built into a side of the tube. At the upper end, port connector 22 may be slidably and sealably adjustable along the tube so that the connector may be adjusted to a sealed fit anywhere along the length of the upper portion of the tube. In addition, the upper portion of the tube may be constructed to be adjustable in length, as by sealed telescoping sections.

Having described our invention and the manner of its use, it should be apparent to those skilled in the relevant arts that incidental modifications may be made thereto that fairly fall within the scope of the following appended claims.

I claim:

1. A mobile fuel pumping and dispensing apparatus for use in emergencies where installed pumps and dispensing apparatus at a fueling station are nonfunctional to pump fuel from one or more existing tanks at said fueling station, said mobile fuel pumping and dispensing apparatus comprising:

a vehicle configured for transporting said fuel pumping and dispensing apparatus to said one or more existing tanks at said fueling station, said fuel pumping and dispensing apparatus further comprising:

at least one tube or hose configured for placing in communicating relation with said fuel in said one or more existing tanks at said fueling station, at least one pump communicating with said at least one tube or hose, a source of power for powering said pump, at least one fuel dispensing station coupled to said at least one pump, said fuel dispensing station comprising at least a resettable fuel meter for metering quantity of dispensed fuel for each consumer, a dispensing hose connected to said dispensing station and a dispensing nozzle connected to said dispensing hose, said dispensing nozzle configured to fit a fueling port of a consumer vehicle, whereby metered quantities of fuel are provided to respective ones of a plurality of consumer vehicles at said fueling station when said installed pumps and dispensing apparatus at said fueling station are nonfunctional.

2. A mobile fuel pumping and dispensing apparatus as set forth in claim 1 wherein said at least one tube or hose is inserted into said at least one tank a distance so that an end of said at least one tube or hose is closely adjacent to or resting on a bottom of said at least one tank.

3. A mobile fuel pumping and dispensing apparatus as set forth in claim 2 further comprising a display that displays said metered quantities of fuel and cost of said metered quantities of fuel.

4. A mobile fuel pumping and dispensing apparatus as set forth in claim 3 wherein said vehicle further comprises a truck.

5. A mobile fuel pumping and dispensing apparatus as set forth in claim 4 wherein said truck further comprises a pickup truck.

6. A mobile fuel pumping and dispensing apparatus as set forth in claim 5 wherein said fuel dispensing station is mounted to a rack that extends across a bed of said pickup truck.

7. A mobile fuel pumping and dispensing apparatus as set forth In claim 3 wherein said mobile fuel pumping and dispensing apparatus is mounted to a skid transportable for deploying at said fueling station.

8. A mobile fuel pumping and dispensing apparatus as set forth in claim 3 wherein said vehicle comprises a trailer.

9. A mobile fuel pumping and dispensing apparatus as set forth in claim 3 wherein said fuel pumping and dispensing apparatus further comprises a plurality of fuel dispensing stations for allowing a plurality of consumers to fuel vehicles simultaneously.

10. A mobile fuel pumping and fueling apparatus as set forth in claim 9 further comprising a pump and hose for each of said tanks, and further wherein each dispensing station allows selection from a plurality of different fuels.

11. A mobile fuel pumping and fueling apparatus as set forth in claim 10 further comprising credit and debit card transaction apparatus in each said dispensing station.

12. A mobile fuel pumping and dispensing apparatus for use in emergencies where installed pumps and dispensing apparatus at a fueling station are nonfunctional to pump fuel from a plurality of existing tanks of differing types of fuel at said fueling station, said mobile fuel pumping and dispensing apparatus comprising:

a vehicle for transporting said fuel pumping and dispensing apparatus to said fueling station for use, a plurality of hoses, one hose of said plurality of hoses for a respective tank of said plurality of existing tanks of differing types of fuel from which fuel is to be dispensed, means coupled to said hoses for pumping said fuel from said plurality of existing tanks of differing types of fuel, a power source for powering at least said means coupled to said hoses, a plurality of fuel dispensing stations connected to said means coupled to said hoses, said plurality of fuel dispensing stations mounted on said mobile fuel pumping and dispensing apparatus, each said dispensing station comprising a resettable fuel meter for metering a quantity of dispensed fuel, a dispensing hose connected to said dispensing station and a dispensing nozzle connected to said dispensing hose, said dispensing nozzle configured to fit a fueling port of a consumer vehicle, whereby metered quantities of fuel are provided to respective ones of a plurality of consumer vehicles at said fueling station when said installed pumps and dispensing apparatus at said fueling station are nonfunctional.

13. A mobile fuel pumping and dispensing apparatus for use in emergencies as set forth in claim 12 wherein each hose of said plurality of hoses are each inserted into a filling opening of a respective said fuel tank, each said hose extending sufficiently into a respective said tank so that ends of said hoses are closely adjacent or resting on a bottom of respective said tanks.

14. A mobile fuel pumping and dispensing apparatus for use in emergencies as set forth in claim 13 wherein said means coupled to said hoses further comprises a pump, said pump coupled to dispense fuel from each of said plurality of fuel dispensing stations.

15. A mobile fuel pumping and dispensing apparatus for use in emergencies as set forth in claim 13 wherein said means coupled to said hoses further comprises a plurality of pumps, one pump for each said differing type of fuel.

16. A mobile fuel pumping and dispensing apparatus for use in emergencies as set forth in claim 15 wherein said plurality of fuel dispensing stations each provides a selection of differing types of fuel to consumers.

17. A mobile fuel pumping and dispensing apparatus for use in emergencies as set forth in claim 13 wherein said power source comprises an electrical generator, for generating electrical power.

18. A mobile fuel pumping and dispensing apparatus for use in emergencies as set forth in claim 17 wherein said plurality of fuel dispensing stations each further comprises a display of cost of a dispensed quantity of fuel and a display of metered quantity of fuel, said display of cost and said display of metered quantity of fuel powered by said electrical generator.

* * * * *